United States Patent [19]

Federighi

[11] Patent Number: 4,721,232

[45] Date of Patent: Jan. 26, 1988

[54] ANTI-CLOGGING STRUCTURE FOR CONTAINERS

[76] Inventor: George J. Federighi, 70 - 13th St., San Francisco, Calif. 94103

[21] Appl. No.: 886,781

[22] Filed: Jul. 18, 1986

[51] Int. Cl.[4] ..... B65D 83/06

[52] U.S. Cl. ..... 222/196.5; 222/196.1

[58] Field of Search ..... 222/196.1, 196.2, 196.3, 222/196.4, 196.5, 463, 500; 241/168

[56] References Cited

U.S. PATENT DOCUMENTS

| | | | |
|---|---|---|---|
| 392,052 | 10/1888 | Mitchell | 222/196.4 |
| 846,256 | 3/1907 | Smith | 222/196.1 |
| 874,509 | 12/1907 | Isbell | 222/196.1 |
| 2,643,797 | 6/1953 | Soares et al. | 222/196.5 |
| 2,762,533 | 9/1956 | Collora | 222/196.2 |
| 3,221,944 | 12/1965 | Brennom | 222/196.1 X |
| 3,402,859 | 9/1968 | Turner | 222/196.5 |

FOREIGN PATENT DOCUMENTS

| | | | |
|---|---|---|---|
| 385160 | 12/1923 | Fed. Rep. of Germany | 222/196.5 |
| 2401271 | 7/1974 | Fed. Rep. of Germany | 222/196.1 |

*Primary Examiner*—F. J. Bartuska
*Assistant Examiner*—Kevin P. Shaver
*Attorney, Agent, or Firm*—Harris Zimmerman; Howard Cohen

[57] ABSTRACT

A housing containing a movable weight is situated at the base of a container to facilitate dispensing of cohesive or viscous substances from the container. When the container is inverted and shaken, the weight repeatedly impacts against the container base creating vibrations which jar loose materials that tend to resist dispensing. The construction is applicable to salt or pepper shakers, catsup bottles and a variety of other containers of comestible or non-comestible substances that may not always flow freely out of the container.

1 Claim, 4 Drawing Figures

ANTI-CLOGGING STRUCTURE FOR CONTAINERS

TECHNICAL FIELD

This invention relates to containers of the type which are inverted and shaken to dispense substances from the container. More particularly, the invention relates to structure for faciltating the dispensing of cohesive or viscous substances from such containers.

BACKGROUND OF THE INVENTION

A variety of products that are customarily stored in small containers consist of cohesive particles or viscous fluids which resist dispensing from the container. Condiments such as salt, pepper and catsup are well known examples and a number of non-comestibles, such as cleansing powders and thick liquid detergents among others, have similar characteristics.

Vigorous shaking of the inverted container is the customary procedure for dislodging clogged contents but is not always effective or at least fully effective. One must then resort to striking the container with ones hand or some other object or to impacting the base of the container against a table or other surface.

Depending on the degree of clogging, such procedures can be an inconvenience and in some cases may be jarring and distracting both to the person attempting to dispense a substance from the container and to others as well. In some instances such operations can damage or break the container. Thus it would be advantageous to reduce the amount of shaking that is needed and to avoid or at least reduce incidences where resort to more strenuous operations becomes necessary.

The present invention is directed to overcoming one or more of the problems discussed above.

SUMMARY OF THE INVENTION

In one aspect, the invention provides a container for storing and dispensing a cohesive or viscous substance, the container having a base and at least one opening at the top through which the substance is dispensed by inverting the container. The container has a subchamber which is located below the base when the container is in an upright position and has a movable weight disposed in the subchamber. The weight has a height which is less than the height of the subchamber whereby the weight impacts against the base when the container is inverted.

In another aspect, the invention provides a container for dispensing substances that tend to stick within the container, the container having a base at a first end and a mouth at the opposite end through which the substance is dispensed. A housing is located at the first end of container adjacent the base and has a sub-base which is spaced from the base of the container and which forms a subchamber in conjunction with the container base. A movable weight is disposed in the subchamber and has first and second opposite surfaces which respectively face the base and the sub-base, the spacing of the surfaces being less than the distance between the base and sub-base whereby the weight oscillates between the base and sub-base when the container is shaken.

In still another aspect, the invention provides a device for facilitating dispensing of a substance from a container which container has a base at one end and at least one opening at the other end through which the substance is dispensed. The device includes a housing having a resilient sleeve portion proportioned to be fitted onto the one end of the container and to elastically grip the container. The housing has a sub-base portion forming an end wall at one end of the sleeve portion and has means for limiting entry of the container into the sleeve portion in order to define a subchamber within the housing between the base and sub-base when the container is fitted into the sleeve portion. A weight is disposed in the subchamber and is proportioned to be movable within the subchamber by shaking of the device.

The invention enhances the effects of shaking of a container by causing an impact against the base of the container when it is inverted followed by repeated impacts when the container is shaken. The resulting vibrations jar clogged material loose thereby enabling dispensing of the contents of the container in desired amounts. The invention functions automatically in response to the customary shaking of the container without requiring additional actions to dislodge cohesive or viscous substances.

DETAILED DESCRIPTION OF THE PREFERRED EMBODIMENTS

Figure 1:
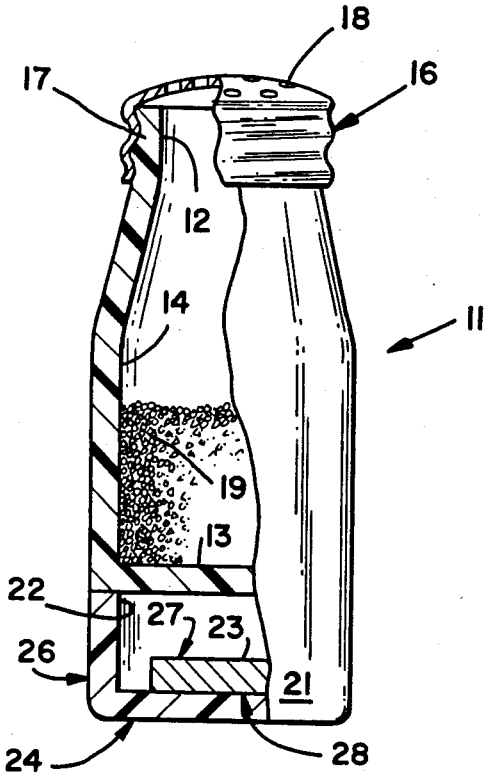
FIG. 1 is a broken out elevation view of a salt shaker in accordance with a first embodiment of the invention.

Referring initially to FIG. 1 of the drawing, the container 11 of this embodiment is a salt shaker for purposes of example but it should be recognized that the invention may also be applied to a variety of other containers of the general type that are inverted in order to discharge contents through a mouth 12 or the like at the upper end of the container.

The upper and intermediate portions of container 11 may be of a conventional salt shaker configuration and thus include a base 13 from which a cylindrical sidewall 14 extends upward to the mouth 12, the upper portion of the sidewall being of progressively smaller diameter as it approaches the mouth. A removable cap 16 is engaged on threads 17 at the mouth 12 of the container and has a plurality of spaced apart apertures 18 through which the salt 19 is dispensed when the container is inverted and shaken.

The salt shaker container 11 may have other shapes and may be formed of any of a variety of materials, the container of this embodiment being formed of plastic for purposes of example.

Dispensing of the salt 19 from container 11 is facilitated by a housing 21 forming a subchamber 22, adjacent container base 13, in which a movable weight 23 is disposed. Housing 21 in this example has a sub-base portion 24 spaced apart from the container base 13 and a cylindrical sidewall portion 26 which extends up from the rim of the sub-base portion to the rim of the container base. The housing 21 of this example is permenently secured to the container base 13 although it may be a removable unit as will hereinafter be described in connection with another embodiment. Securing of the housing 21 to the container base 13 may variously be accomplished with adhesives, soldering, screw fasteners or the like depending on the material of which such components are constructed. The housing 21 and container base 13 of this particular example are plastic and may be joined with known solvents.

While other configurations are appropriate in some cases, weight 23 in this example is a flat circular disc formed of heavy material such as steel. The weight has parallel opposite surfaces 27 and 28 respectively facing container base 13 and sub-base 24, the thickness of the weight being smaller than the distance between the base and sub-base enabling oscillation of the weight between the base and sub-base when the container is shaken. Preferably the weight 23 has a diameter somewhat smaller than the diameter of subchamber 22 or alternately the weight may be transpierced by one or more air passages. This prevents air entrapment which could slow the oscillatory motion of the weight 23.

Figure 2:
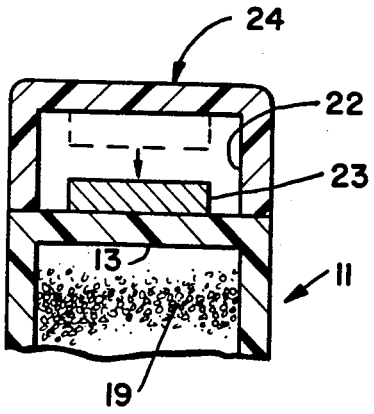
FIG. 2 is a section view of the base region of the salt shaker of FIG. 1 shown in an inverted condition.

In operation, salt 19 is dispensed in the normal manner by inverting the container 19 followed by shaking of the container if necessary. Referring now to FIG. 2, the weight 23 drops and impacts against container base 13 when the container 11 is turned upside down. The resulting vibrations reduce cohesion of the salt 19 grains to the container 11 and to each other. Shaking of the inverted container 11 causes repeated impacts of this kind further loosening the salt. Thus the salt 19 flows more freely from the container 11. Incidences requiring more strenuous operations to unclog the salt are avoided or at least reduced in number.

The flat configuration of the weight 23 is an advantageous one where the container 11 is constructed of brittle material such as glass or easily damaged material such as thin metal as the broad flat surfaces 27 and 28 tend to distribute impact forces over sizable areas of the base 13 and sub-base 24. Weights 23 with rounded surfaces or the like may be used when it is desirable to concentrate the impact force and the container 11 is formed of a material that is not damaged by concentrated stresses.

Figure 3:
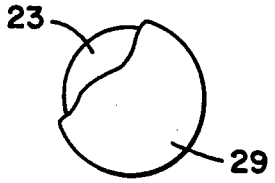
FIG. 3 is a partially broken out view of a modified weight which may be used in the construction of FIG. 1 or in other embodiments of the invention.

Referring now to FIG. 3, impact of the weight 23 can be cushioned to reduce noise and to provide further resistance to damage by covering the weight with a layer 29 of soft fabric, rubber or the like.

Figure 4:
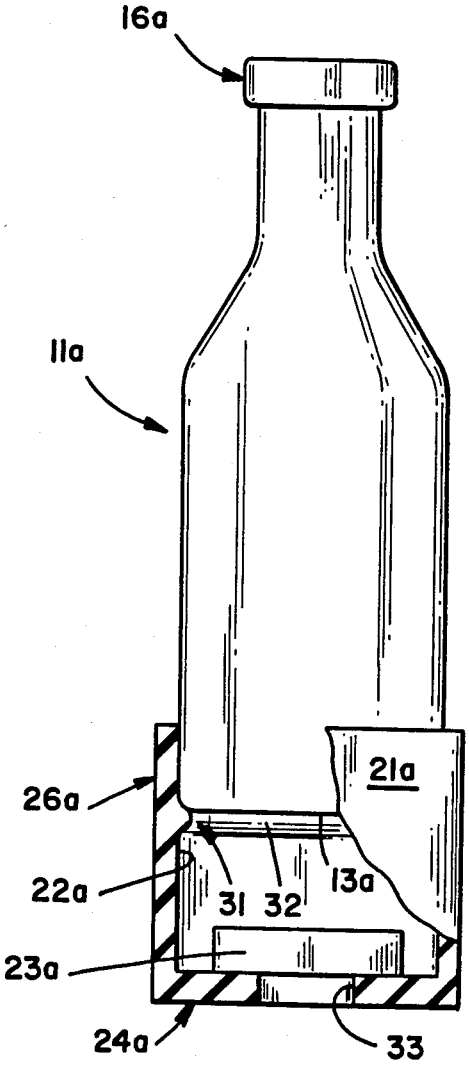
FIG. 4 is a broken out elevation view of another embodiment of the invention which is adapted to be fitted onto pre-existing containers.

Following assembly, the housing 21 of the above described embodiment is a permanent component of the container 11. Referring now to FIG. 4, the housing **21*a* may also be an attachable and detachable unit which can be fastened to a pre-existing container 11*a***, which is a catsup bottle in this example, and which can be removed for reuse with each of a series of such containers.

The housing **21*a* of FIG. 4 is formed of resilient material which is rubber in this example although resilient plastics or the like may also be used. The housing 21*a* has flat circular sub-base 24*a* and a cylindrical sleeve portion 26*a* which extends upward from the sub-base. At least the upper region of sleeve portion 26*a* has a diameter slightly less than the diameter of the base 13*a* of container 11*a*. The base 13*a* of the container 11*a* is forced into the upper region of sleeve portion 26*a* of the housing 21*a*. As this requires some expansion of the sleeve portion 26*a*, the housing 21*a* then elastically grips the container 11*a*** and resists separation although it can be removed for use with another container by exerting sufficient force.

The container **11*a* is not inserted completely through the sleeve portion 26*a* of housing 21*a* and thus the container base 13*a* and spaced apart sub-base 24*a* define a subchamber 22*a*. Means 31 may be provided to limit entry of the container 11*a* into the sleeve portion 26*a* to assure that a subchamber 22*a* of desired height is present, such means being an annular lip 32 extending around the inner surface of the sleeve portion in this example. The lip 32 is not needed in instances where the material of the sleeve portion 26*a* is sufficiently rigid that it inherently limits entry of the container base 13*a*** to less than the full height of the sleeve portion.

Subchamber **22*a* contains a weight 23*a* which may be similar to that previously described. Thus when the cap 16*a* is removed from the container 11*a* and the container is inverted, weight 23*a* drops and impacts against the base 13*a* of the container. Shaking of the container 11*a* results in repeated impacts which act to reduce cohesion of a viscous liquid such as catsup to the container 11*a*** and which have a momentarily fluidizing effect thereby facilitating the dispensing of the contents of the container.

It is preferable that subchamber **22*a* be communicated with the external atmosphere, such as by an air passage aperture 33 in sub-base 24*a*. This avoids resistance to the fitting of the housing 21*a* onto container 11*a* by entrapped and compressed air and also avoids resistance to removal of the housing arising from a vacuum condition in subchamber 22*a* that might otherwise occur. Weight 23*a* does not block the air passage aperture 33 during assembly and disassembly if such operations are performed with the container 11*a* in an inverted orientation as the weight then rests against container base 13*a***.

While the invention has been described with respect to certain preferred embodiments, many variations are possible and it is not intended to limit the invention except as defined in the following claims.

I claim:

1. A device for facilitating dispensing of a substance from a container by shaking thereof, the container having a base at one end and at least one opening at the opposite end through which said substance is dispensed, comprising a housing having a resilient sidewall extending upwardly and having a continuous upper edge defining an upper opening, said upper opening configured to receive said base of said container in frictionally retained, sealing engagement, stop means for limiting entry of said base of said container into said opening, comprising an annular flange extending radially inwardly from said sidewall and continuously about the inner surface thereof and spaced below said opening, said flange having an inner diameter less than said base to prevent insertion of said base therebeyond, a bottom wall extending across a lower edge of said sidewall and defining with the lower surface of said base and said sidewall a closed chamber beneath the container, a movable weight freely disposed within said chamber, said weight comprising a cylindrical disk, said disk having a diameter slightly less than the diameter of said chamber and a smooth, flat, continuous upper surface adapted to impact on said lower surface of said base and said bottom wall, and aperture means extending from said chamber to the exterior thereof to provide pressure equalization with ambient atmospheric pressure when said container is in sealing engagement in said upper opening.

* * * * *